United States Patent [19]

Yoshino et al.

[11] 4,339,143

[45] Jul. 13, 1982

[54] PRESSURE-SENSITIVE RECORDING MATERIAL

[75] Inventors: Isamu Yoshino, Kunitachi; Yasohachi Takahashi, Urawa; Osamu Fujii, Osaka, all of Japan

[73] Assignees: Mishima Paper Co., Ltd., Tokyo; Naigai Ink. Mgf. Co., Ltd., Osaka, both of Japan; part interest to each

[21] Appl. No.: 205,962

[22] PCT Filed: Dec. 18, 1979

[86] PCT No.: PCT/JP79/00318

§ 371 Date: Aug. 18, 1980

§ 102(e) Date: Jul. 18, 1980

[87] PCT Pub. No.: WO80/01263

PCT Pub. Date: Jun. 26, 1980

[51] Int. Cl.[3] ..... B41M 5/22

[52] U.S. Cl. ..... 282/27.5; 428/206; 428/207; 428/315.5; 428/315.7; 428/315.9; 428/320.2; 428/320.4; 428/320.6; 428/321.5; 428/323; 428/326; 428/484; 428/488; 428/537; 428/914

[58] Field of Search ..... 106/21, 31; 282/27.5; 427/150, 151, 152, 153; 428/307, 323, 326, 328, 488, 537, 914, 195, 204, 206, 207, 209, 210, 315.5, 315.7, 315.9, 320.2, 320.4, 320.6, 321.1, 321.5, 484, 321.3

[56] References Cited

U.S. PATENT DOCUMENTS

| | | | |
|---|---|---|---|
| 3,079,351 | 2/1963 | Staneslow | 260/3 |
| 3,684,549 | 8/1972 | Shank | 428/914 |

FOREIGN PATENT DOCUMENTS

| | | | |
|---|---|---|---|
| 804091 | 12/1973 | Belgium | 282/27.5 |
| 1805844 | 6/1970 | Fed. Rep. of Germany | 282/27.5 |
| 3320473 | 4/1970 | Japan | 282/27.5 |

*Primary Examiner*—Bruce H. Hess

*Attorney, Agent, or Firm*—Wenderoth, Lind & Ponack

[57] ABSTRACT

This invention provides a pressure-sensitive recording material in which two color-forming components capable of forming a colored substance upon reaction with each other are formed on the surfaces of separate supports, for example paper sheets, as a transferable coated layer and a receptive coated layer respectively, said transferable coated layer being a layer of a hot-melt type coating containing one color-forming component, and said receptive coated layer being a layer having absorbent micropores and composed of microcapsules containing the other color-forming component, a fine powder and a binder. By stacking a plurality of such pressure-sensitive recording materials, they can be used as a pressure-sensitive recording business form.

6 Claims, 6 Drawing Figures

PRESSURE-SENSITIVE RECORDING MATERIAL

FIELD OF TECHNOLOGY

This invention relates to a pressure-sensitive recording material which can produce multiple copies when pressure such as printing or writing pressure, is exerted thereon. More specifically, it relates to a pressure-sensitive recording material having a surface coated layer of a novel structure.

Figure 1:
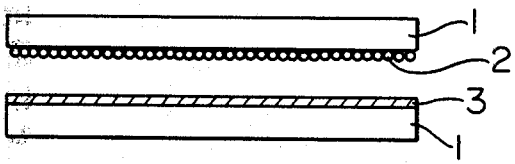
FIGS. 1 to 3 are examples of prior art pressure-sensitive recording materials in which two color-forming components are coated on the surfaces of supports in a face-to-face relationship.

In the drawings, 1 represents a support; 2, a microcapsular layer containing a liquid comprising a color-forming agent; 3, a layer of a solid containing a coloring agent; 4 and 5, layers formed by spot-coating only the desired portions with a hot-melt type coating containing a color-forming agent; 5', a layer formed by coating the entire surface with the hot-melt type coating; and 6, a layer having absorbent micropores consisting of microcapsules, a fine powder and a binder.

BACKGROUND TECHNOLOGY

Pressure-sensitive recording materials having two color-forming components coated on the surfaces of separate supports, which have conventionally gained widespread use, are of the type shown in FIG. 1. Specifically, one of the color-forming components is encapsulated in microcapsules (2) and coated on the undersurface of an upper support (1), and the other color-forming component is present as a coated layer (3) on the top surface of a lower support (1). When a printing or writing pressure is applied to such a pressure-sensitive material, the liquid contained in the microcapsules (2) flows out and is transferred to, and absorbed by, the coated layer (3), and simultaneously, the two color-forming components react with each other to form a colored substance and thus to form an image on the receptive surface of the coated layer (3).

Figure 2:
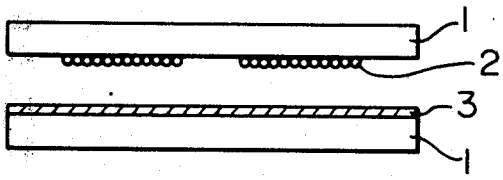

When, in the material of the type shown in FIG. 1, the upper support and the lower support are superimposed and cut or bent, colored stains occur at the parts to which pressure is applied. There is known a pressure-sensitive recording sheet in which microcapsules (2) containing a color-forming component are spot-coated on the undersurface of the upper support, as shown in FIG. 2, in order to inhibit or avoid the occurrence of such an inconvenience. In practice, however, the stop-coating of microcapsules is difficult, because tough capsules which withstand spot-coating are difficult to obtain, and creases form on the coated support because of the use of a water-base coating, etc.

Figure 3:
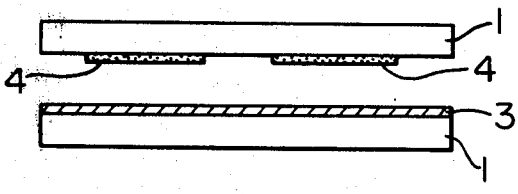

It was thus proposed to form a transferable spot-coated layer (4) by spot-coating a so-called hot-melt ink resulting from the dispersion of a color-forming component in a hot-melt type wax on the undersurface of the upper support (1), as shown in FIG. 3. Although in this type, the color-forming components contained in the transferable coated layer (4) and the receptive coated layer (3) are enveloped by another component (e.g., wax, binder, etc.), when the upper support and the lower support are handled in the superimposed state, colored stains occur under an unexpected exterior force. Furthermore, when a printing or writing pressure is applied, the transferable coated layer (4) is transferred to the receptive coated layer (3), and conversely, the receptive layer (3) is transferred to the transferable layer (4). This results in the formation of an image on both coated layers, and the rate of color formation and the density of the color formed in the receptive coated layer are frequently reduced. If, in an attempt to remove such an inconvenience, the formulation is changed so that the transferable coated layer (4) may not easily be transferred, color formation upon the application of a printing or writing pressure is poor so that a clear image cannot be obtained.

DISCLOSURE OF THE INVENTION

Figure 4:
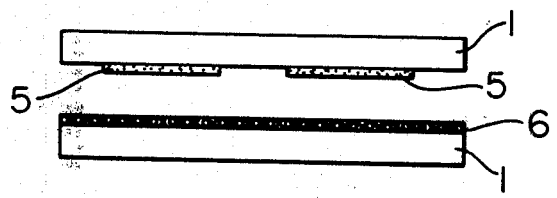
FIGS. 4 and 5 show examples of coated layers in the present invention.
Figure 5:
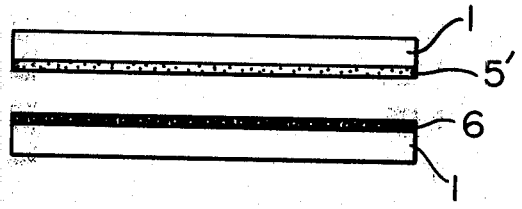

As a material which removes these inconveniences, the present invention provides a pressure-sensitive recording material comprising a transferable coated layer of a hot-melt type coating containing one color-forming component and a receptive coated layer having absorbent micropores and consisting of microcapsules which contain another color-forming component, a fine powder and a binder. FIGS. 4 and 5 illustrate this invention. FIG. 4 shows a material in which a transferable coated layer (5) is spot-coated on the undersurface of an upper support (1), and FIG. 5 shows a material in which a transferable coated layer (5) is coated on the entire undersurface of the upper support (1). In these figures, (6) represents a layer having absorbent micropores and consisting of the microcapsules, a fine powder and a binder, which is applied to the top surface of the lower support (1).

As stated above, many pressure-sensitive recording sheets are of the type in which microcapsules containing one color-forming component as a liquid are kept present in the transferable coated layer when the liquid in the capsules is caused to be transferred to the opposite receptive surface to form a color thereon. In this case, not all of the liquid in the capsules is transferred to the receptive surface, and some remains on the transfer surface without contributing to color formation. In contrast, the present invention is based on the theory that microcapsules are caused to be present in the receptive layer and the liquid therein flows out and is absorbed in the layer, instead of causing microcapsules containing a color-forming component to be present in the transferable coated layer and transferring them to the receptive coated layer. Because the color-forming component in the capsules changes effectively to a colored substance which directly forms an image on the receptive surface, both the rate of color formation and the density of the color formed increase. For the same reason, it is not necessary to incorporate a large amount of the coloring component. Thus, the first feature of the present invention is that microcapsules containing one color-forming component are included in the receptive coated layer.

The second feature of the present invention is the use of a hot-melt type coating containing a color-forming component in the transferable coated layer. As is well known, the hot-melt type coating is called a hot-melt ink or hot-melt wax, and has the advantage that this coating is easy to spot-coat and needs only to be cooled after coating without the need for drying, and moreover, the coating head is simple and the rate of coating can be increased. When the hot-melt coating is used in the construction shown in FIG. 3, inconveniences are caused. However, when in accordance with this invention, the transferable coated layer composed of such a hot-melt coating containing a color-forming component is combined with the structure in which the microcapsules are included in the receptive coated layer, i.e. the first feature described above, the advantages of the two cooperate with each other to give good results.

The combination of the first and second features alone is still inconvenient, however. If the microcapsules are ruptured immediately before the hot-melt type coating of the transferable coated layer is transferred upon the application of printing pressure to the surfaces of the microcapsules in the receptive coated layer, the liquid comes out and is transferred to the transferable coated layer to form a color. Or because the hot-melt type coating cannot be transferred, an image is not formed well. Hence, the results are undesirable.

Thus, according to this invention, the receptive coated layer is formed as a layer of the structure having absorbent micropores and composed of microcapsules, a fine powder and a binder, and the liquid which comes out upon the application of pressure is instantaneously and completely absorbed in the receptive coated layer. By so doing, the hot-melt type coating is completely transferred, and back-transferring of the liquid does not occur. The layer of the structure having absorbent micropores also has an action of protecting the microcapsules against an external force.

In preparing the receptive coated layer, appropriate conditions corresponding to the size of the capsules, the amount of the binder, and the shape, size and size distribution of the fine powder should be selected so that the volume of the pores is larger than the total volume of the liquid in the capsules to provide absorbent micropores having the aforesaid function. The following table shows experimental examples which show the relation of the blending proportions of the capsules, the fine powder and the binder in the preparation of a receptive layer to the function of the receptive layer formed. In these experiments, a hot-melt coating containing 30% of Silton Clay (a product of Mizusawa Kagaku) was used as the transferable layer.

capillary should be as small as possible. However, in order for a large amount of the liquid to be absorbed within short periods of time, the diameter of the capillary should be as large as possible. In the receptive coated layer in this invention, it is desirable for the liquid which has flowed from the microcapsules to be instantaneously and completely absorbed by the aforesaid coated layer. Consequently it is desirable that the diameter of absorbent micropores should be large. However, since the size of the microcapsules is usually about 1 to 10 microns and the amount of the liquid contained in the microcapsules is small, if the diameter of pores existing in the neighborhood is too large, the liquid does not at all move along the pores, that is, it is not absorbed. Accordingly, the diameter of the absorbent micropores should be smaller than about 10 microns. Furthermore, in order to increase the ability of absorbing liquid, the total volume of the pores should be large.

Usually, the microcapsules are spherical when they are dispersed in a liquid, but when they are coated and dried, they form a nearly continuous phase with not so much interstices left among the microcapsules. Thus, the interstices are filled with the powder or a fine fibrous powder in order to leave fine spaces after drying.

Generally speaking, when spheres of the same diameter are filled in a box, 26% of the space remains in the case of closest packing, and 50% of the space remains in the case of bulky packing. In a cylindrical filament, 22% of the space likewise remains. Thus, if a coated layer is formed on a support by means of a coating composed of microcapsules and various fine powders and dried, the aforesaid space should remain. However, if a binder is added to prevent picking of the dried coated layer, the amount of the space decreases according to the amount of the binder in the layer. If the amount of the binder increases beyond the amount of the space, no absorbent micropore will remain.

The above is based on presumption from calculated values. The fine powders in actual use are not spherical or cylindrical but irregularly shaped. Thus, the particle size distribution exists continuously, and there may be a deviation from the calculated values. The above table shows a part of this situation. When the receptive layer and the transferable layer are set opposite to each other and letters are printed, an image appears in the transferable layer upon the migration of the color-forming com-

| | | Examples of formulation of the receptive coated layer and the densities of colors | | | | | | | |
|---|---|---|---|---|---|---|---|---|---|
| | Run No. | 1 | 2 | 3 | 4 | 5 | 6 | 7 | 8 |
| Amounts blended (parts) | Microcapsules (1) | 50 | 40 | 30 | 25 | 20 | 15 | 10 | 5 |
| | Precipitated calcium carbonate (2) | 45 | 45 | 45 | 45 | 45 | 45 | 45 | 45 |
| | Polyvinyl alcohol (3) | 15 | 15 | 15 | 15 | 15 | 15 | 15 | 15 |
| Microcapsules in the coated layer (%) | | 45.5 | 40.0 | 33.3 | 29.4 | 25.0 | 20.0 | 14.3 | 7.7 |
| Density of image | Receptive coated surface | +++ | +++ | +++ | +++ | +++ | +++ | ++ | ++ |
| | Transferable coated surface | +++ | +++ | +++ | ++ | ++ | − | − | − |

+++: High density;
++: medium density;
+: low density;
−: density nearly zero.
(1) Gelatin capsules obtained in a customary manner (containing a colorless dye).
(2) A product of Shiraishi Calcium (PC), average particle size 2 microns.
(3) A product of Denki Kagaku (Denka Size A-50).

The formation and effect of absorbent micropores are described further.

Generally, in order for a liquid to penetrate into a capillary and reach a distant point, the diameter of the ponent in the microcapsules to the color-forming component of the transferable layer. This shows that the liquid contained in the ruptured microcapsules cannot be fully absorbed by the receptive layer and the excess of the liquid is transferred to the transferable surface. In the above experiments, when the amount of the microcapsules in the receptive coated layer is less than 20%, the liquid in the microcapsules is all absorbed by the receptive coated layer to prevent coloration at the transferable coated layer.

The total volume of the absorbent micropores which gives such an effect has to do not only with the amount of a fine powder to be blended, but also directly with the amount of the binder added. The total pore volume decreases when the binder is added in a large amount, and increases when it is added in a small amount. Moreover, when the support is absorbent, it absorbs the binder incorporated in the coating, and changes the amount of the binder remaining in the dried coated layer. Accordingly, the absorbency of the support also affects the total pore volume.

In the examples of coating formulations shown in the above table, wood-free paper having a basis weight of 43 g/m$^2$ is used as a support, and precipitated calcium carbonate and polyvinyl alcohol are added to microcapsules. Depending upon the materials used, for example upon the selection of the support, microcapsules, fine powder or binder, the same results are not always obtained. Usually, good results can be obtained by adjusting the proportions of the individual components in the coated layer as follows:

| | |
|---|---|
| Microcapsules: | 10 to 35% |
| Fine powder: | 70 to 50% |
| Binder: | 20 to 15% |

Of course, the proportions of the fine powder and the binders should be selected properly within the aforesaid ranges in order to form absorbent micropores of the desired volume. In short, in the present invention, the amounts of the fine powder and binder should be selected properly so that the total amount of the liquid in the microcapsules does not exceed the total pore volume of the absorbent micropores formed in the receptive coated layer.

The support in this invention is mainly paper. However, since in this invention the receptive coated layer is given the ability to absorb a liquid, a non-absorbent material such as plastic films and metal foils may optionally be used. Thus, there is no particular limit to the material for the support.

As the color-forming components, various combinations of compounds which react with each other to form a colored substance can be used. Since in this invention, one component of the combination is used in the form of a hot-melt type coating, substances having strong volatility at about 100° C. or substances which are liquid at room temperature are undesirable. There can be used combinations of colorless dyes of the triphenylmethane phthalide, fluoran, phenothiazine, indolyl phthalide, leuco auramine, spiropyran, triphenylmethane, triazene, naphtholactam, benzopyrane, azomethine, hydroxyphthalane types, etc. with inorganic color developing agents such as activated clay, colloidal silica or zeolite and various organic color developing agents. The compounds in these combinations may be used interchangeably in the transferable coated layer and the receptive coated layer. A combination of a ferric salt of a fatty acid with a higher alcohol ester of gallic acid, and a combination of a vanadium compound such as stearyl trimethyl ammonium vanadate and a higher alcohol ester of gallic acid are also used. If desired, these combinations may be used as mixtures.

The fine powder, as used in the present invention, denotes various inorganic and organic white pigments, starch particles, wood cellulose powder, etc. It should not be one which forms a color upon contact with the microcapsules containing a color-forming component. This is because even when the color-forming component is kept inside the microcapsules, it is by no means sure that the color-forming component does not at all adhere to the outside wall of the capsules. For example, for capsules containing crystal violet lactone, etc., fine powders which do not cause color formation, such as calcium carbonate or aluminum hydroxide are desirable.

In addition, the shape, size and size distribution of the fine powder have to do with the formation of absorbent micropores, and become factors which determine the rate and amount of absorbing the liquid in the capsules. Although it is difficult to express these parameters by numerical figures, desirable fine powders are those which exhibit a nearly spherical shape and have a particle diameter of 0.5 to 20 microns and a particle size distribution which is concentrated as much as possible on one point. The wood cellulose powder desirably has a size of less than 300 mesh.

Natural and synthetic polymers which do not form a color with the color-forming component are used as the binder. Since the amount of the binder added is an important factor in forming absorbent micropores, it should be determined so as to maintain a balance against the amount of the capsules by considering the aforesaid calculated values of the remaining space at the time of filling spherical bodies into a box and the shape, size and size distribution of the fine powder used.

Since the hot-melt type coating should be transferable, it is desirable to form a primer layer before its coating. As the primer, the above-exemplified polymers used as binders may be used. Those having good effect of sealing are selected.

Materials for the hot-melt type coating other than the color-forming component include, for example, high-melting natural waxes such as carnauba wax, candelilla wax and montan wax, oils and fats, hardened oils, higher fatty acids, polyvalent metal salts of higher fatty acids, petroleum waxes, and other involatile high-melting substances. If desired, minor amounts of involatile solvents may be added. Furthermore, stabilizers such as antioxidants and ultraviolet absorbents may be added as required.

POSSIBILITY OF UTILIZATION IN INDUSTRY

A stack of a plurality of the pressure-sensitive recording materials of this invention can be used as a pressure sensitive recording business form.

BEST MODE OF PRACTICING THE INVENTION

The present invention is illustrated specifically by the following Examples. These Examples are for the purpose of illustrating preferred modes of practicing the invention, and the invention is not limited thereto.

EXAMPLE 1

Microcapsules containing colorless dyes were prepared in the following manner.

Crystal violet lactone (50 g) and 30 g of benzoyl leuco methylene blue were dissolved in alkylnaphthalene (KMC-113, Kureha Chemical) to form 1000 g of a solution. The solution was dispersed in a solution of 200 g of gelatin in 1500 g of water with stirring at high speed by a homomixer. Then, a solution of 40 g of carboxy methyl cellulose in 3000 g of water was added. Furthermore, 2000 g of water was added. Then, 90 g of 10% acetic acid was added to adjust the pH of the mixture to 4.0. The solution was then cooled with ice to 7° C., and 150 g of 37% formaldehyde was added, and then 300 g of 4% sodium hydroxide was added to adjust the pH of the mixture to 9.0. The mixture was maintained at 50° C. for 1 hour, and 200 g of wood cellulose powder (KC Flock-300, Sanyo Kokusaku Pulp) was added. The mixture was then stored at room temperature. If desired, some amount of an ultraviolet absorbent may be added to the alkylnaphthalene.

The formulation (parts by weight) of a coating for the receptive coated layer was as follows:

| | |
|---|---|
| Aforesaid microcapsular solution (solids) | 15 |
| Precipitated calcium carbonate (Shiraishi Calcium) | 45 |
| Polyvinyl alcohol (Denki Kagaku) | 15 |

An aqueous dispersion of the above formulation having a solids concentration of 18% was coated by an air knife at a rate of 3.5 g/m$^2$ on wood free paper having basis weight of 40 g/m$^2$ and consisting of 70% LBKP and 30% NBKP. An 8% polyvinyl alcohol solution had been coated on the back surface of the paper by a Meyer bar to prevent curling and give barrier property as a primer for the transferable coated layer. Then, a hot-melt type coating for the transferable coated layer consisting of the following formulation was spot-coated at a rate of 3.0 g/m$^2$ by a hot-melt transfer gravure technique to that surface of the paper which had been given barrier property as above. The formulation (parts by weight) of the hot-melt coating was as follows:

| | |
|---|---|
| Silton Clay (Mizusawa Kagaku) | 300 |
| Stearic acid | 300 |
| Hardened castor oil | 100 |
| Carnauba wax | 100 |
| Beef tallow | 200 |

The above ingredients were melt-mixed by a kneader at 80° C., and used as the hot-melt type coating.

Figure 6:
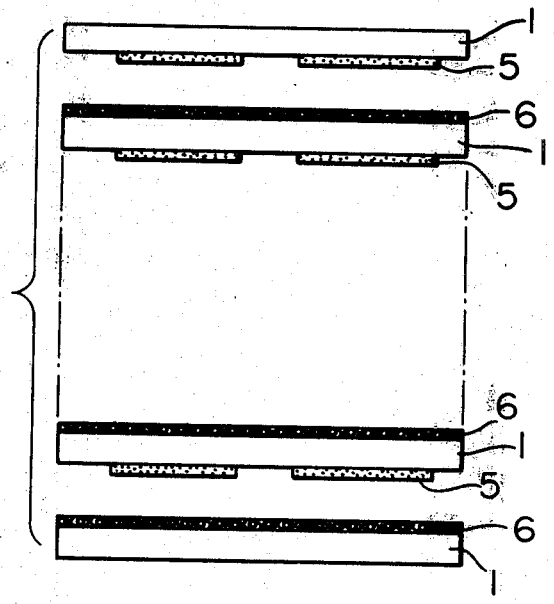
FIG. 6 shows an example of a spot-type pressure-sensitive recording business form which utilizes the pressure-sensitive recording materials of this invention. All of these drawings are cross-sectional views.

Ten paper sheets coated both at the top and back surfaces in the above manner were superimposed to form a pressure-sensitive recording business form of the structure shown in FIG. 6 (the illustration of six intermediate sheets is omitted). When letters were printed on the resulting assembly by an electric typewriter, clear blue letters could be rapidly printed even on the lowermost sheet (10th sheet).

When relief printing was performed on the surface of the receptive coated layer, troubles were not seen as was the case with relief printing on wood free paper.

When a pressure-sensitive recording business form as made in the same way as above using the receptive coated layer obtained in Run No. 7 in the above table, the same good results as above were obtained.

EXAMPLE 2

In the same way as in Example 1, microcapsules containing an iron compound were prepared. That is, 80 g of a ferric salt of mixed coconut oil fatty acid was dissolved in oxyethylene lauryl ether (Actinol, Matsumoto Kosan) to form 1000 g of a solution. Using the resulting solution, microcapsules were prepared.

A coating for a receptive coated layer was also prepared in accordance with Example 1.

The formulation (parts by weight) of a hot-melt type coating for a transferable coated layer opposite thereto was as follows:

| | |
|---|---|
| Lauryl gallate | 80 |
| Stearic acid | 300 |
| Hardened castor oil | 120 |
| Glycerol monostearate | 100 |
| Carnauba wax | 100 |
| Beef tallow | 200 |
| Aluminum hydroxide (Shoden H-42) | 100 |

Ten coated sheets obtained in accordance with Example 1 were superimposed and letters were printed on the assembly. The rate of color formation was somewhat lower than in Example 1, but a black image having good fastness to light was obtained.

We claim:

1. A pressure-sensitive recording material in which two color-forming components capable of forming a colored substance upon reaction with each other are formed on the surfaces of separate supports as a completely transferable coated layer and a receptive coated layer respectively, said transferable coated layer being a layer of a hot-melt type coating containing one color-forming component, and said receptive coated layer being a layer having absorbent micropores and composed of 10 to 35% of microcapsules containing a liquid containing the other color-forming component, 70 to 50% of a fine powder which does not react with the color-forming components to form a color, and 20 to 15% of a binder which does not react with the color-forming components to form a color, the diameter of said micropores being less than 10 microns, and the total volume of the micropores being greater than the total volume of the liquid within the microcapsules.

2. The pressure-sensitive recording material set forth in claim 1 wherein the fine powder has a particle diameter of 0.5 to 20 microns.

3. The pressure-sensitive recording material set forth in claim 1 or 2 wherein said supports are paper sheets, plastic films or metal foils.

4. The pressure-sensitive recording material set forth in claim 1 or 2 wherein said layer of hot-melt type coating consists of one of the color-forming components and a high-melting natural wax, an oil, a fat, a higher fatty acid, a polyvalent metal salt of a higher fatty acid, a petroleum wax or another involatile high-melting substance.

5. The pressure-sensitive recording material set forth in claim 1 or 2 wherein said fine powder is an inorganic white pigment, an organic white pigment, starch particles, or wood cellulose powder.

6. The pressure-sensitive recording material set forth in claim 1 or 2 wherein said binder is a natural or synthetic polymer.

* * * * *

UNITED STATES PATENT AND TRADEMARK OFFICE

CERTIFICATE OF CORRECTION

PATENT NO. : 4,339,143

DATED : July 13, 1982

INVENTOR(S) : Isamu Yoshino, Yasohachi Takahashi and Osamu Fujii

It is certified that error appears in the above-identified patent and that said Letters Patent are hereby corrected as shown below:

On the title page:

In the heading of the Patent, Item [73], correct the name of the second Assignee to read --Naigai Ink Mfg. Co., Ltd.--

Signed and Sealed this

*Twenty-fifth* Day of *January 1983*

[SEAL]

*Attest:*

GERALD J. MOSSINGHOFF

*Attesting Officer*

*Commissioner of Patents and Trademarks*